US008544685B2

(12) United States Patent
Swanick

(10) Patent No.: US 8,544,685 B2
(45) Date of Patent: Oct. 1, 2013

(54) RECLOSABLE DISPENSING CLOSURE

(75) Inventor: Ken P. Swanick, Arlington Heights, IL (US)

(73) Assignee: Calibre Closures LLC, Roselle, IL (US)

( * ) Notice: Subject to any disclaimer, the term of this patent is extended or adjusted under 35 U.S.C. 154(b) by 447 days.

(21) Appl. No.: 12/875,862

(22) Filed: Sep. 3, 2010

(65) Prior Publication Data

US 2011/0056982 A1 Mar. 10, 2011

Related U.S. Application Data

(60) Provisional application No. 61/240,473, filed on Sep. 8, 2009, provisional application No. 61/308,718, filed on Feb. 26, 2010.

(51) Int. Cl.
*B67D 1/00* (2006.01)

(52) U.S. Cl.
USPC ..... 222/83; 222/85; 222/153.07; 222/556

(58) Field of Classification Search
USPC ..... 222/81–83.5, 85, 153.08, 520, 521, 222/541.2, 548, 556; 220/266, 267, 278, 220/277
See application file for complete search history.

(56) References Cited

U.S. PATENT DOCUMENTS

| | | | | | |
|---|---|---|---|---|---|
| 1,250,081 | A | | 12/1917 | Bennis | |
| 1,259,057 | A | | 3/1918 | Vick | |
| 2,701,668 | A | | 2/1955 | Zayan | |
| 3,227,317 | A | * | 1/1966 | Bereziat et al. | 222/83 |
| 3,369,707 | A | * | 2/1968 | Porter et al. | 222/83 |
| 3,383,007 | A | * | 5/1968 | Salamone | 220/277 |
| 3,472,411 | A | | 10/1969 | Turner | |
| 3,581,605 | A | | 6/1971 | Taylor | |
| 3,653,546 | A | | 4/1972 | Hazard | |
| 3,659,750 | A | | 5/1972 | La Vange | |
| 3,762,432 | A | * | 10/1973 | Peterson, Jr. | 137/317 |
| 3,774,822 | A | | 11/1973 | Hazard | |
| 4,221,291 | A | | 9/1980 | Hunt | |
| 4,345,696 | A | * | 8/1982 | Guimarin | 220/277 |
| 4,506,809 | A | | 3/1985 | Corsette | |
| 4,747,497 | A | | 5/1988 | Holman | |

(Continued)

OTHER PUBLICATIONS

Int'l Search Report & Written Opinion issued is application No. PCT/US10/47857 (2010).

(Continued)

*Primary Examiner* — Kevin P Shaver
*Assistant Examiner* — Daniel R Shearer
(74) *Attorney, Agent, or Firm* — Barnes & Thornburg LLP

(57) ABSTRACT

A dispensing closure for a vessel comprising a base member and a spout member engaged with the base member. The base member including a rupture member having a camming surface and the spout member having a cam actuator for engaging the camming surface to rupture the rupture member during twisting of the spout member in a first direction relative to the base member from a sealed position to a flow position to define a flow opening in the base member to permit fluid flow through the flow opening. The dispensing closure may include a pair of spaced rupture members and cam actuators. The dispensing closure may include a cap member hingedly attached to the spout member. The dispensing closure may include tamper evidency ring or other structure and a locking mechanism configured to lock the cap member in the closed position until the cap member and spout are rotated a sufficient distance to break the tamper evidency ring.

20 Claims, 5 Drawing Sheets

(56) References Cited

U.S. PATENT DOCUMENTS

| | | | | |
|---|---|---|---|---|
| 4,883,192 | A * | 11/1989 | Krugman | 220/711 |
| 5,020,681 | A | 6/1991 | Kusz | |
| 5,141,138 | A | 8/1992 | Odet et al. | |
| 5,398,829 | A * | 3/1995 | Stubbs | 215/256 |
| 5,402,904 | A * | 4/1995 | Close | 220/254.3 |
| 5,482,176 | A | 1/1996 | Maietta et al. | |
| 5,692,633 | A * | 12/1997 | Gordon | 220/253 |
| 5,797,521 | A | 8/1998 | Sobral | |
| 6,334,555 | B1 * | 1/2002 | Randall et al. | 222/521 |
| 6,367,622 | B1 | 4/2002 | Hsu | |
| 6,422,412 | B1 | 7/2002 | Sagawa | |
| 6,477,743 | B1 | 11/2002 | Gross et al. | |
| 6,513,650 | B2 | 2/2003 | Mollstam et al. | |
| 6,571,994 | B1 | 6/2003 | Adams et al. | |
| 6,679,375 | B1 | 1/2004 | Coory | |
| 6,702,161 | B2 | 3/2004 | Adams et al. | |
| 6,745,923 | B2 | 6/2004 | Julian | |
| 6,786,330 | B2 | 9/2004 | Mollstam et al. | |
| 6,793,104 | B2 | 9/2004 | Kao | |
| 6,851,576 | B2 | 2/2005 | Dubach | |
| 6,896,161 | B2 | 5/2005 | Patz | |
| 7,178,683 | B2 | 2/2007 | Birkmayer et al. | |
| 7,207,465 | B2 | 4/2007 | Weist | |
| 7,261,226 | B2 | 8/2007 | Adams et al. | |
| 7,337,921 | B2 | 3/2008 | Ma | |
| 7,367,964 | B2 | 5/2008 | Heinz et al. | |
| D571,199 | S | 6/2008 | Petrosino et al. | |
| 7,410,071 | B1 | 8/2008 | Seib et al. | |
| 2003/0000963 | A1 | 1/2003 | Julian | |
| 2003/0106911 | A1 | 6/2003 | Adams et al. | |
| 2006/0057257 | A1 | 3/2006 | Ma | |
| 2007/0045134 | A1 | 3/2007 | Dvorak et al. | |
| 2007/0181522 | A1 | 8/2007 | Davidson | |
| 2008/0124432 | A1 | 5/2008 | Ma | |
| 2008/0156802 | A1 | 7/2008 | Yauk et al. | |
| 2009/0020495 | A1 | 1/2009 | Cheng | |
| 2009/0050648 | A1 | 2/2009 | Wisniewski | |

OTHER PUBLICATIONS

Office Action of Oct. 10, 2012 for U.S. Appl. No. 13/361,425.

* cited by examiner

RECLOSABLE DISPENSING CLOSURE

CROSS REFERENCE TO RELATED APPLICATIONS

This Application claims priority from U.S. Provisional Patent Application Ser. Nos. 61/240,473 filed Sep. 8, 2009, and 61/308,718 filed Feb. 26, 2010, the contents of which applications are herein incorporated by reference in their entireties.

BACKGROUND

The present disclosure is directed to a reclosable dispensing closure for a bottle or other fluid vessel.

Reclosable dispensing closures have been employed with a wide variety of products, including water, juices, condiments and detergents. The dispensing closure can be opened and closed without removing or separating any portion of the dispensing closure from the container.

There are several styles of reclosable dispensing closures currently commercially available. For example, pull/push and screw type are two common designs. In both of these popular designs, the common theme is that there is a base and a spout installed together in an assembly. These designs rely upon multiple sealing surfaces to create an airtight dispensing closure for distribution and handling of the product.

A disadvantage of these designs is that sealing is not consistent because of manufacturing tolerances, slight burrs, and other manufacturing and assembly irregularities. As a result, current reclosable dispensing closure designs are unable to maintain adequate pressure in the bottles, which limits otherwise available uses for the bottles. For example, carbonated beverages and solutions cannot be marketed in bottles with these dispensing closures, because they would lose their carbonation and be rendered useless to the consumer. Further, bottling companies prefer to pressurize their products prior to shipment, which prevents damage to the product during transit, but these designs cannot adequately maintain the pressure. Pressurization otherwise also allows the bottler to reduce the wall thickness of the dispensing bottle, and rely on internal pressure to support the product during transit and handling. If included, tamper evidency structure increases these challenges.

SUMMARY OF THE DISCLOSURE

The present disclosure is directed to a dispensing closure for a vessel containing fluid comprising a base member engageable with the vessel and a spout member engaged with the base member, one of the base member and the spout member including a rupture member having a camming surface and the other of the base member and the spout member having a cam actuator for engaging the camming surface to rupture the rupture member during twisting of the spout member in a first direction relative to the base member from a sealed position to a flow position to define a flow opening in said one of the base member and the spout member and to permit fluid flow through the flow opening. Said one of the base member and the spout member may also have an other rupture member having an other camming surface and said other of the base member and the spout may have an other cam actuator for engaging the other camming surface to rupture the other rupture member during twisting of the spout member in the first direction relative to the base member from the sealed position to the flow position to define an other flow opening in the spout member and to permit fluid flow through the other flow opening.

In illustrated embodiments, the spout member and the base member are coaxial and the rupture member is arcuate, and the dispensing closure may further comprise a stop on the other of the base member and the spout member adjacent the rupture member to limit further twisting in the first direction of the spout member relative to the base member. The rupture member may be hingedly attached to the stop after the spout member is rotated to the flow position. The dispensing closure may further comprise areas of reduced thickness disposed about the rupture member configured to be broken when the spout member is twisted to the flow position to rupture the rupture member and permit the rupture member to pivot relative to the stop.

The dispensing closure may include a cap member hingedly connected to the spout member and moveable from a closed position to seal the slot and an open position to open the spout. It may also include a tamper evidency ring frangibly secured to the base member and further comprise a locking mechanism for securing the cap member in the closed position and for preventing the cap member from moving to the flow position unless the cap member and spout member are rotated relative to the base member a sufficient distance to break the tamper evidency ring.

The present disclosure is also directed to a dispensing closure for a vessel containing fluid comprising a base member engageable with the vessel and a spout member engaged with the base member. The base member includes an enclosure surface for sealing the vessel having a pair of rupture members, each having a camming surface. The spout member has a pair of cam actuators for engaging the camming surfaces for rupturing the rupture members during twisting of the spout member in a first direction relative to the base member from a sealed position to a flow position to define flow openings in the base member and to permit fluid flow from the vessel through the flow openings. The spout member and the base member may be coaxial and the rupture members may be arcuate and have arc lengths relative to the coaxis of the spout member and the base member of about 30 degrees. The enclosure surface may further comprise a pair of stops adjacent respective rupture members to limit further twisting in the first direction of the spout member relative to the base member, the rupture members hingedly attached to respective stops.

The dispensing closure is configured to maintain pressure in the bottle. The dispensing closure in accordance with one or more of the illustrated embodiment may eliminate the need for a foil liner over the spout of the vessel to maintain pressure.

Features and advantages of the disclosure will be set forth in part in the description which follows and the accompanying drawings described below, wherein embodiments of the disclosure is described and shown, and in part will become apparent upon examination of the following detailed description taken in conjunction with the accompanying drawings.

BRIEF DESCRIPTION OF THE DRAWINGS

The present disclosure and advantages thereof will become more apparent upon consideration of the following detailed description of an illustrated embodiment when taken in conjunction with the accompanying drawings.

DETAILED DESCRIPTION

Figure 1:
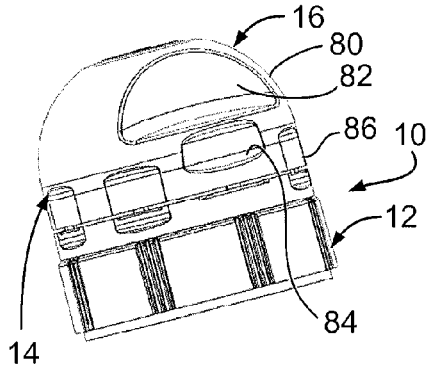
FIG. 1 is a perspective view of a dispensing closure in accordance with a first illustrated embodiment of the present disclosure.
Figure 2:
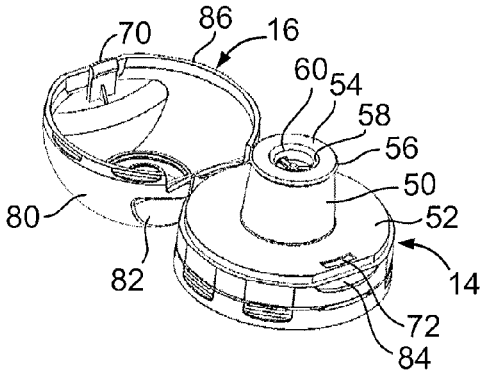
FIG. 2 is a perspective view of the dispensing closure of FIG. 1, illustrating the cap member in an open position relative to the spout and base members.
Figure 3:
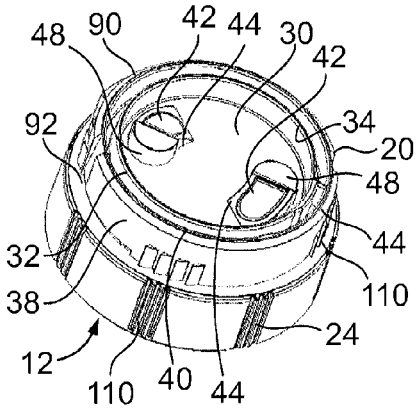
FIG. 3 is a side perspective view of the base member of the dispensing closure of FIG. 1.
Figure 4:
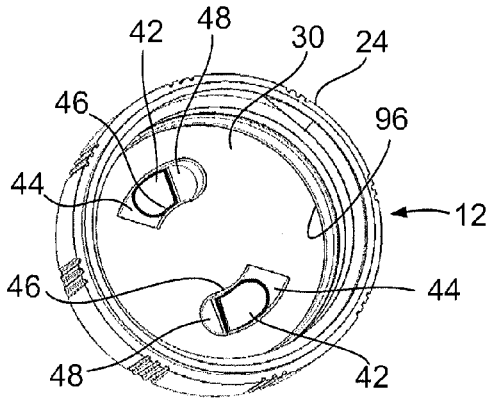
FIG. 4 is a bottom perspective view of the base member of the dispensing closure of FIG. 1.
Figure 5:
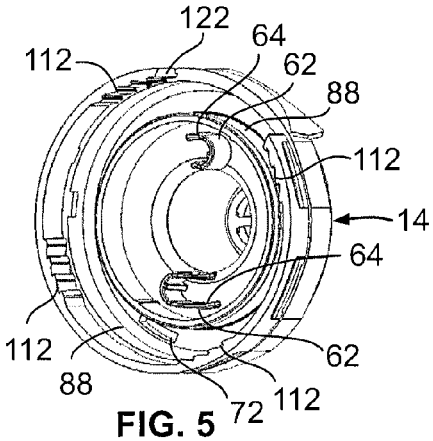
FIG. 5 is a bottom perspective view of the spout member of the dispensing closure of FIG. 1.
Figure 6:
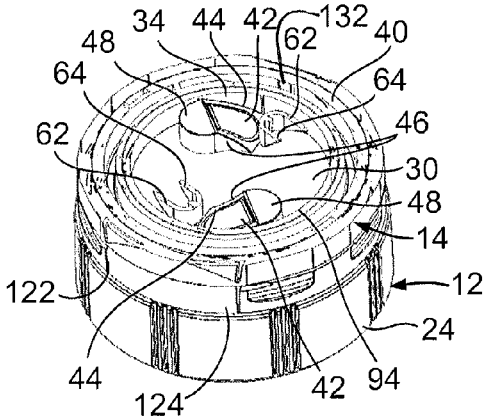
FIG. 6 is a partial perspective view of the dispensing closure of FIG. 1, illustrating the spout member in partial, the base member and the cam actuators of the spout member for rupturing the rupture members of the spout member.
Figure 7:
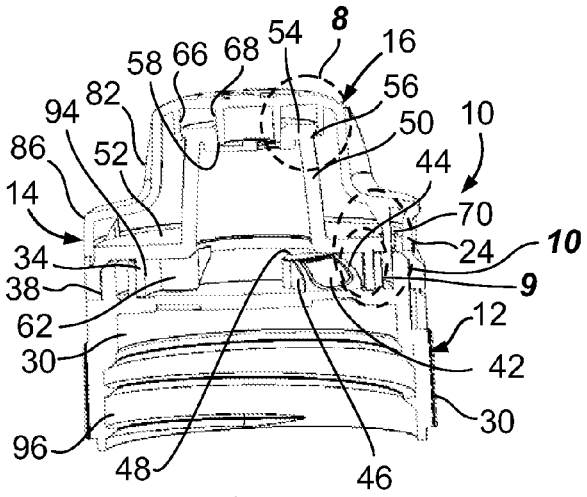
FIG. 7 is a cross sectional view of the spout and base members of the dispensing closure of FIG. 1.
Figure 8:
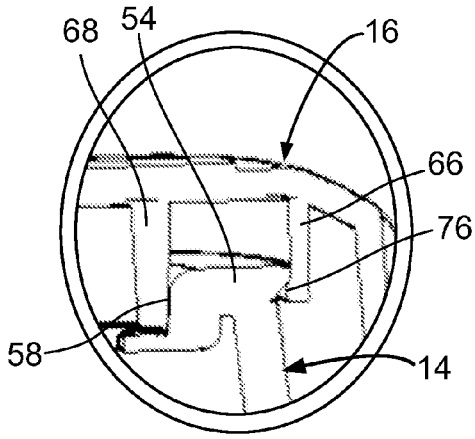
FIG. 8 is an enlarged view of Detail 8 of FIG. 7.
Figure 9:
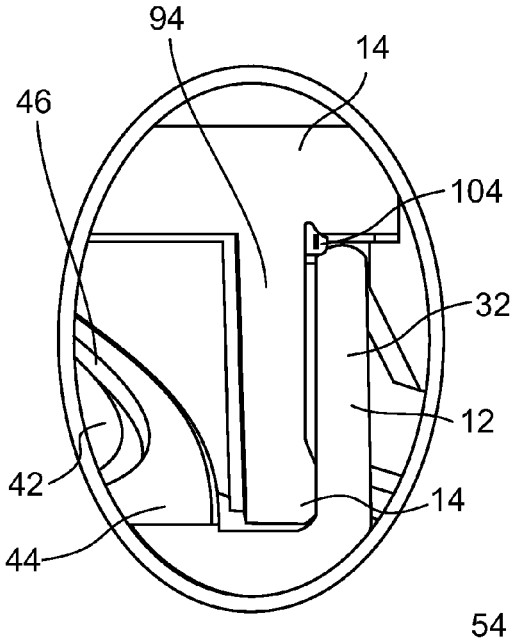
FIG. 9 is an enlarged view of Detail 9 of FIG. 7.
Figure 10:
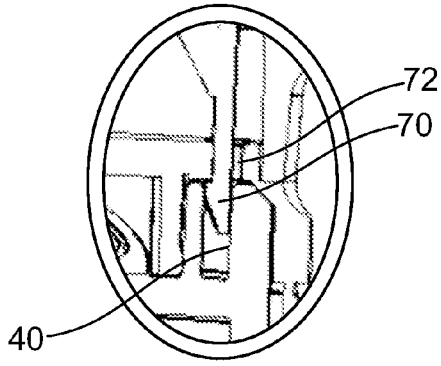
FIG. 10 is an enlarged view of Detail 10 of FIG. 7.
Figure 11:
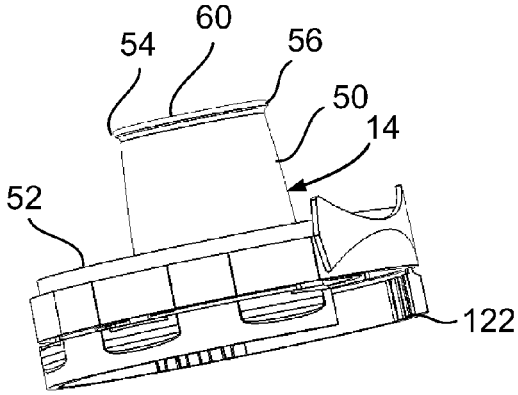
FIG. 11 is a perspective view of the spout member of the dispensing closure of FIG. 1.
Figure 12:
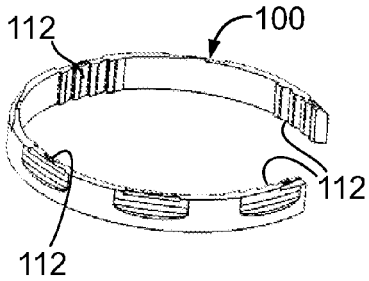
FIG. 12 is a plan view of the tamper evidency ring of the spout member of FIG. 10 after it has been broken off.

FIGS. 1-12 illustrate a dispensing closure 10 in accordance with an illustrated embodiment of the disclosure for a bottle or other vessel that contains fluids or liquids. The dispensing closure 10 comprises a base member 12 engageable with the bottle, a spout member 14, and a cap member 16 hingedly secured or otherwise attached to the spout member by a living hinge or the like. The dispensing closure 10 may be constructed of any suitable plastic or may be constructed of any other material in accordance with other embodiments of the present disclosure. The base member 12 is comprised of a body 20 and a lower skirt 24. The body 20 includes an enclosure surface 30, a rim 32 surrounding and extending vertically from the enclosure surface 30 that define an interior bore 34, and an external rim 38 that defines a slot 40. The enclosure surface 30 is circular and the body 20 seals the bottle and prevents fluid flow from the bottle into the bore 34. The base member 12 and spout member 14 have generally circular cross sections and are assembled in a coaxial manner as described below.

The enclosure surface 30 includes a pair of rupture members in the form of a pair of circumferentially-spaced rupture arms 42; a pair of rupture arm supports 44, each partially or completely surrounding one of the rupture arms 42; and areas or lines of reduced thickness 46 interconnecting the rupture arms 42 and the rupture arm supports 44 configured to be broken. The rupture arms 42, the rupture arm supports 44, and the lines of reduced thickness 46 have an arcuate construction, with the rupture arms having an arcuate length of about 30 degrees. The rupture arms 42 also slope upward from the bottle to form camming surfaces. The rupture arm supports 44 slope upward to complement the slope of the camming surfaces of the rupture arms 42. The enclosure surface 30 also includes a pair of stops 48 positioned adjacent each of the rupture arm supports 44. The stops 48 may be connected to the rupture arms 42. In the illustrated embodiment, the entire base member 12, including the rupture arms 42, the rupture arm supports 44, the lines of reduced thickness 46 and the stops 48, has a monolithic construction.

The spout member 14 includes a spout 50 and a lid 52 disposed about the base of the spout. The spout 50 comprises a generally cylindrical wall that terminates in a ledge 54 that includes an annular outer bead 56 and inner face 58 and defines an exit hole 60. The bottom surface of lid 52 includes a pair of cam actuators 62 configured to rupture the rupture arms 42. The cam actuators 62 each comprise a U-shaped wall that engages one of the rupture arms 42 during twisting of the spout member 14 relative to the base member 12. The U-shaped wall defines a bore 34. The U-shaped wall decreases in height from its closed end to its open end.

The cap member 16 is pivotable relative to the spout member 14 between a closed position and an open position, and is rotatably coupled to the spout member. The cap member 16 is generally coaxial with the base member 12 and spout member 14, when it is in the closed position. The cap member 16 includes a first annular wall 66 and a second annular wall 68 disposed about the first annular wall. When the cap member 16 is in the closed position, the first annular wall 66 engages the inner face 58 of the spout 50 to close the exit hole 60 of the spout and the second annular wall 68 includes an inner bead 76 that engages the bead 56 of the spout to further seal the spout. When the cap member 16 is pivoted to the open position, the exit hole 60 is open for fluid flow. The cap member 16 also includes a flexible hook 70 that is received by an opening 72 defined by the lid 52 of the spout member 14 to releasably lock the cap member 16 in the closed position.

The cap member 16 may have a generally hemispherical outer shell 80 with a pair of flats 82 for twisting the cap member and spout member 14 relative to the base member 12. The cap member and spout member 14 define a notch 84 for opening the cap member 16 relative to the spout member 14. The cap member 16 also includes a cap skirt 86 for securing the cap member to the perimeter of the lid 52 of the spout member 14.

During the initial assembly process, the spout member 14 is snapped into place over the base member 12 by aligning the engaging bosses 88 of the spout member 14 over the chamfered slots 90 defined by the body 20 and applying pressure straight down. During assembly, the engaging bosses 88 travel over the chamfers defining the chamfered slots 90 and upon completion of assembly are locked in place fully engaged by the diametrically opposed slots 92 defined by the body 20 of the base member 12. During assembly, the cap member 16 is in the closed position relative to the spout member 14 with the hook 70 received by the opening 72 of the spout member 14. An internal wall 94 of the spout member 14 engages the rim 32 of the base member 12. The internal wall includes an outer bead 102 and the rim 32 includes an inner bead 104 to provide enhanced sealing. The base member 12 and spout member 14 can be assembled in any other suitable manner in accordance with other embodiments of the present disclosure.

After assembly, the dispensing closure 10 is threadingly engaged or otherwise secured to the bottle in any suitable manner. The bottle may have any suitable construction and may be constructed of plastic, glass or any other suitable material. Because the rupture arms 42 have not been ruptured, liquid cannot pass through the enclosure surface 30, and the base member 12 provides an airtight dispensing closure so that the pressure in the bottle can be maintained effectively at a constant level. Thus, the dispensing closure 10 is initially in a sealed position with the base member 12 sealing the bottle to maintain the pressure within the bottle or to otherwise seal the bottle.

Activation of dispensing closure 10 to allow dispensing of fluid from the bottle may occur by gripping the cap member 16 by its flats 82 and twisting the cap member 16 and spout member 14 relative to the base member 12 from the sealed position to a flow position. During twisting, the cam actuators 62 engage the rupture arms 42, causing camming of the cam actuators 62 over the rupture arms 42, which in turn causes the lines of reduced thickness 46 to break and the rupture arms 42 to deflect downwardly into or towards the bore 96 defined by the base member 12. Continued rotation of the cap member 16 and the spout member 14 forces the rupture arms 42 to travel further down into or towards the bore 96. The back of the rupture arms 42 may remain hingedly secured to the stops 48. This action defines a flow opening in the enclosure surface 30 of the base member 12 between the rupture arms 42 and the rupture arm supports 44 and releases pressure from the bottle into the dispensing closure 10. This opening creates fluid openings for the fluid to flow out of the bottle and allowing fluid to pass into bore 34. The bores 64 defined by the cam actuators 62 further facilitate fluid flow. When the cap member 16 is pivoted to the open position, the fluid may pass through exit hole 60. The stops 48 limit the degree of rotation of the spout member 14 to 30 degrees or to another desired degree of rotation. The engagement of sealing surfaces creates a seal at the base member of the assembly directing the fluid upwards. Thereafter, the cap member 16 may be moved back to the closed position to seal the spout 50.

The dispensing closure 10 also may include tamper evidency means. For example, the spout member 14 may also include a tamper evidency ring 100 frangibly attached to the body 20 of the base member 12. Once the dispensing closure 10 is installed on the bottle, twisting of the spout member 14 will completely or substantially separate the temper evidency ring 100 from the spout member and base member 12. In the illustrated embodiment, the body 20 includes four spaced sets of teeth or ribs 110 and the ring 100 includes four mating sets of teeth or ribs 112 matingly engaged with the ribs 110 when the dispensing closure is in its assembled state. The temper evidency ring 100 extends annularly less than 360 degrees to define an arcuate void 122, and the body 20 of the base member 12 also includes an arcuate boss 124 received by the arcuate void. During twisting of the spout member 14 relative to the base member 12, the ribs 110 and 112 and the boss 124 cause the tamper evidency ring to separate from the rest of the spout member, thereby showing evidency of use or tampering of the dispensing closure 10.

The above-described dispensing closure 10 also includes a locking mechanism for securing the cap member 16 and spout member 14 in the sealed position that also prevents opening of the cap member 16 until the cap member and spout member 14 are rotated to break the tamper evidency ring 100. The base member 12 defines a slot 40 for receiving the hook 70 of the cap member 16 during assembly. The hook 70 passes through the opening 72 of the spout member 14 and into slot 40 of the base member 12. The base member 12 includes a detent 132 adjacent the slot 40 that prevents the hook 70 from disengaging from the slot 40 until the cap member 16 and spout member 14 are rotated a sufficient distance towards the flow position to separate the tamper evidency ring 100 from the base member 12.

The dispensing closure 10 may have any other suitable construction in accordance with other embodiments of the present disclosure. For example, it may have a single or multiple number of rupture arms 42 and cam actuators 62 and associated structures in accordance with other embodiments of the present disclosure. Further the rupture arms 42 and cam actuators 62 may have any other suitable construction in accordance with other embodiments of the present disclosure.

Figure 13:
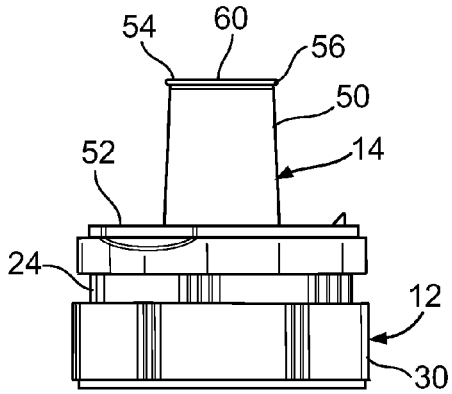
FIG. 13 is a plan view of the spout member and base member of the dispensing closure of FIG. 1 after the tamper evidency ring has been broken off.
Figure 14:
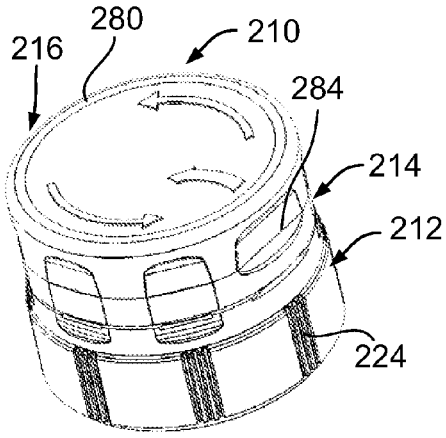
FIG. 14 is a perspective view of a dispensing closure in accordance with another embodiment of the present disclosure.
Figure 15:
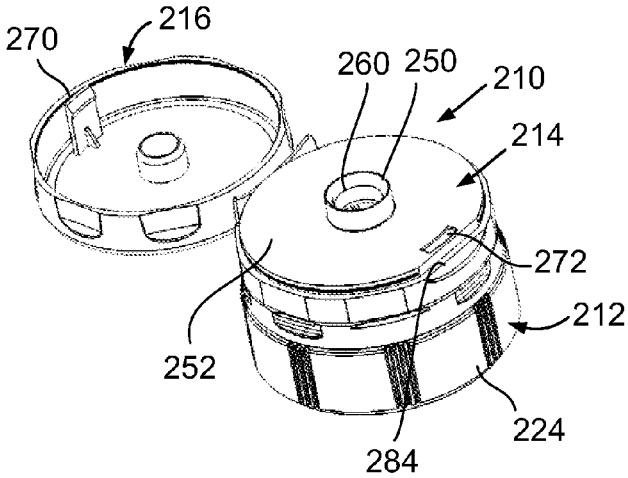
FIG. 15 is a perspective view of the dispensing closure of FIG. 14, illustrating the cap member in an open position.
Figure 16:
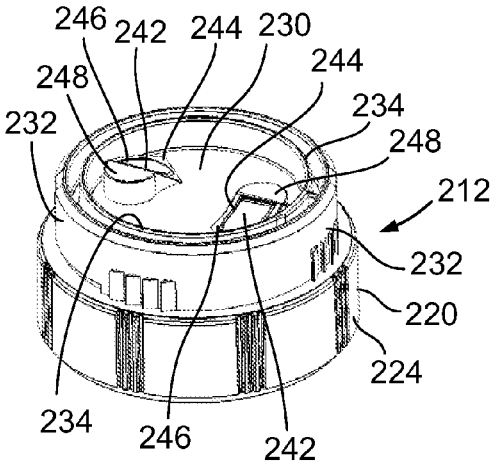
FIG. 16 is a side perspective view of the base member of the dispensing closure of FIG. 14.
Figure 17:
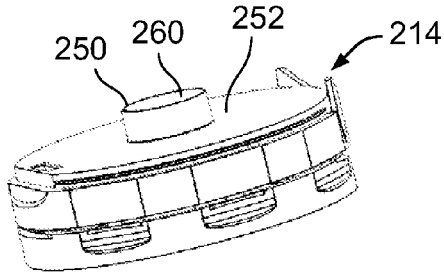
FIG. 17 is a side perspective view of the spout member of the dispensing closure of FIG. 14.
Figure 18:
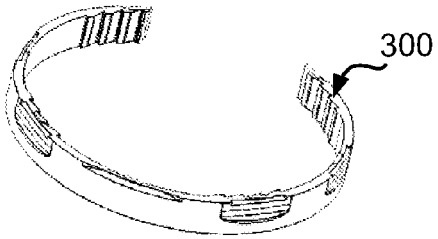
FIG. 18 is a perspective view of the tamper evidency ring after it has been broken off from the spout member of FIG. 17.
Figure 19:
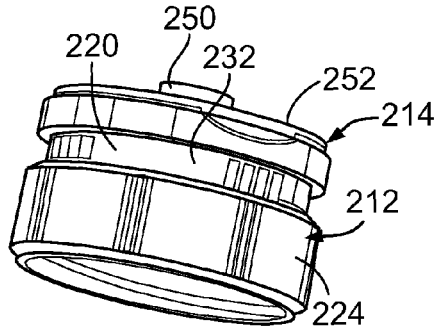
FIG. 19 is a perspective view of the spout and base members of the dispensing closure of FIG. 14 after the tamper evidency ring has been broken off.
Figure 20:
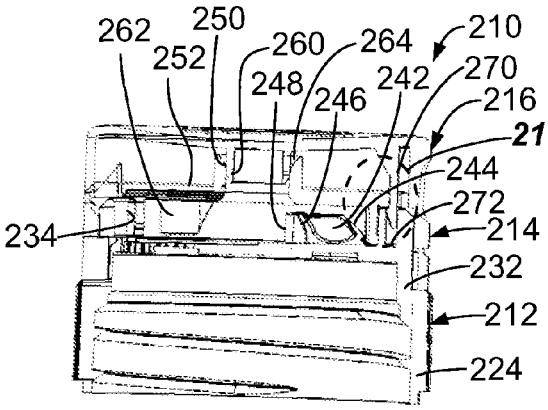
FIG. 20 is a cross sectional view of the dispensing closure of FIG. 14.
Figure 21:
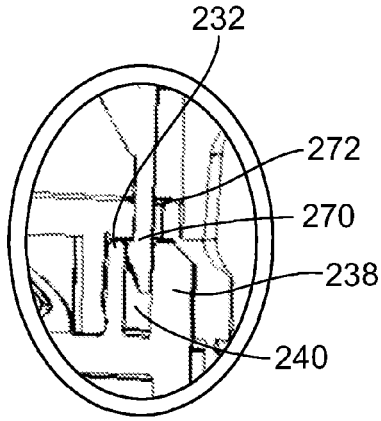
FIG. 21 is an enlarged view of Detail 21 of FIG. 20.

FIGS. 13-21 illustrate a dispensing closure 210 in accordance with an other illustrated embodiment of the disclosure of a bottle or other vessel which may be useful for condiments or for other fluids or liquids. The dispensing closure 210 comprises a base member 212, a spout member 214, and a cap member 216 hingedly secured to the spout member by a living hinge or the like. The dispensing closure 210 may be constructed of any suitable plastic or may be constructed of any other material in accordance with other embodiments of the present disclosure. The base member 212 is comprised of a body 220 and a lower skirt 224. The body 220 includes an enclosure surface 230, a rim 232 surrounding and extending vertically from the enclosure surface 230 that defines an interior bore 234, and an annular rim 238 that defines a slot 240. The base member 212 and spout member 214 have generally circular cross sections and are assembled in a coaxial manner. The enclosure surface 230 is circular and prevents fluid flow from the bottle into the bore 234.

The enclosure surface 230 includes a pair of rupture members in the form of a pair of circumferentially-spaced rupture arms 242; a pair of rupture arm supports 244, each partially or completely surrounding one of the rupture arms 242; and lines or areas of reduced thickness 246 interconnecting the rupture arms 242 and the rupture arm supports 244 configured to be broken, with the rupture arms 242 having an arcuate length of about 30 degrees. The rupture arms 242, the rupture arm supports 244 and the lines of reduced thickness 246 have an arcuate construction. The rupture arms 242 also slope upward from the enclosure surface 230 to form camming surfaces. The rupture arm supports 244 slope upward to complement the camming surfaces of the rupture arms 242. The enclosure surface 230 also includes a stop 248 positioned adjacent each of the rupture arms 242. The stops 248 may be connected to the rupture arms 242. In the illustrated embodiment, the entire base member 212, including the rupture arms 242, the rupture arm supports 244, the areas of reduced thickness 246, and the stops 248, has a monolithic construction.

The spout member 214 includes a spout 250 and a lid 252 disposed about the base of the spout. The spout 250 comprises a cylindrical wall that defines an exit hole 260. The bottom surface of lid 252 includes a pair of cam actuators 262 configured to rupture the rupture arms 242. The cam actuators 262 may be similar in construction to the cam actuators 62 of dispensing closure 10. Each comprise a U-shaped wall that engages the camming surface of one of the rupture arms 242 during twisting of the spout member 214 relative to the base member 212. The U-shaped wall defines a bore. The U-shaped wall decreases in height from its closed end to its open end.

The cap member 216 is pivotable relative to the spout member 214 between a closed position and an open position. The cap member 216 includes a generally cylindrical plug 264. When the cap member 216 is in the closed position, the plug 264 is received by the exit hole 260 to close the exit hole 260. When the cap member 216 is in the open position, the exit hole 260 is open for fluid flow. The cap member 216 also includes a flexible hook 270 that is received by an opening 272 defined by the lid 252 of the spout member 214 to releasably lock the cap member 216 in the closed position. The cap member 216 may have a generally hemispherical circular shell 280.

The base member 212 and the spout member 214 may be assembled together in any suitable manner such as, for example, in a manner similar to the process described above with respect to the closure 10. After assembly, the dispensing closure 210 is secured to a bottle (not shown) in any suitable manner. The bottle may have any suitable construction and may be constructed of plastic, glass or any other suitable material. Because the rupture arms 242 have not been ruptured, liquid cannot pass through the enclosure surface 230, and the base member 212 provides an airtight dispensing closure so that the pressure in the bottle can be maintained effectively at a constant level or otherwise provides a tight seal. The base member 212 and spout member 214 may have a sealing structure similar to the sealing structure of dispensing closure 210 or any other suitable sealing structure.

Activation of dispensing closure 210 to allow dispensing of fluid from the bottle may occur by gripping the cap member 216 and twisting the cap member 216 and spout member 214 relative to the base member 212 to the fluid flow position. During twisting, the cam actuators 262 engage the rupture arms 242, causing camming which in turn cause the areas of reduced thickness 246 to break and the rupture arms 242 to deflect downwardly into or towards the bore 296. Continued rotation of the spout member 214 forces the rupture arms 242 to travel further down into or towards the bore 296. The back of the rupture arms 242 may remain hingedly secured to the stops 248. This action defines an opening in the enclosure surface 230 of the base member 212 between the rupture arms 242 and the rupture arm supports 244 and releases pressure from the bottle through the dispensing closure 210. This opening creates passages for the fluid to flow out of the bottle and allowing fluid to flow into bore 234. The bores defined by the cam actuators 262 further facilitate fluid flow. When the cap member 216 is moved to the open position, the fluid may pass through exit hole 260. The stops 292 limit the degree of rotation of the spout member 214. The engagement of sealing surfaces creates a seal at the base member of the assembly directing the fluid upwards.

The dispensing closure 210 also may include tamper evidency means such as, for example, the tamper evidencing structure similar or identical to the tamper evidency structure disclosed above in connection with dispensing closure 10. It may also include a locking mechanism for securing the cap member in the closed position that also prevents opening of the cap member 216 until the cap member and spout member 214 are rotated to break the tamper evidency ring 300, as described above in connection with dispensing closure 10.

The above-described dispensing closure 210 also includes a locking mechanism for securing the cap member 216 and spout member 214 in the sealed position that also prevents opening of the cap member 216 until the cap member and spout member 214 are rotated to break the tamper evidency ring 300. The base member 212 defines a slot 240 for receiving the hook 270 of the cap member 216 during assembly. The hook 270 passes through the opening 272 of the spout member 214 and into slot 240 of the base member 212. The base member 212 includes a detent adjacent the slot 240 that prevents the hook 270 from disengaging from the slot 240 until the cap member 216 and spout member 214 are rotated a sufficient distance towards the flow position to separate the tamper evidency ring 300 from the base member 212.

The dispensing closure 210 may have any other suitable construction in accordance with other embodiments of the present disclosure. For example, it may have a single or multiple number of rupture arms 242 and cam actuators 262 and associated structures in accordance with other embodiments of the present disclosure. Further the rupture arms 242 and cam actuators 262 may have any other suitable construction in accordance with other embodiments of the present disclosure.

Figure 22:
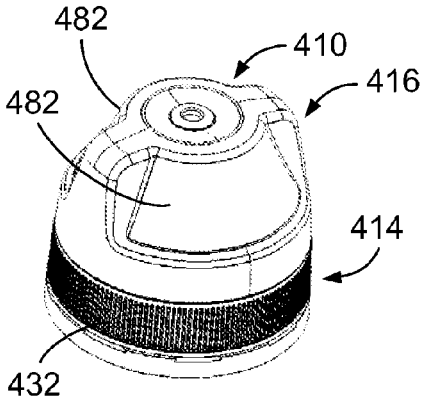
FIG. 22 is a perspective view of a dispensing closure in accordance with another illustrated embodiment of the present disclosure.
Figure 23:
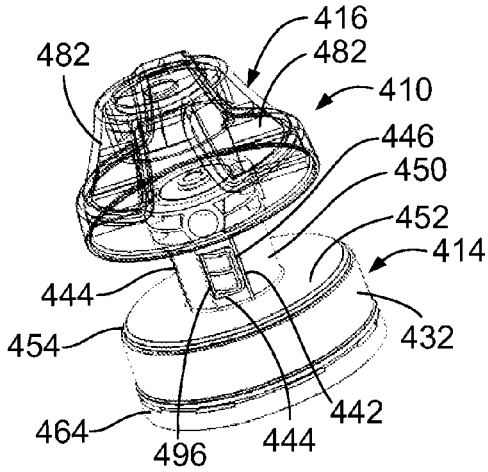
FIG. 23 is a perspective view of the dispensing closure of FIG. 22, illustrating the cap member being removed.
Figure 24:
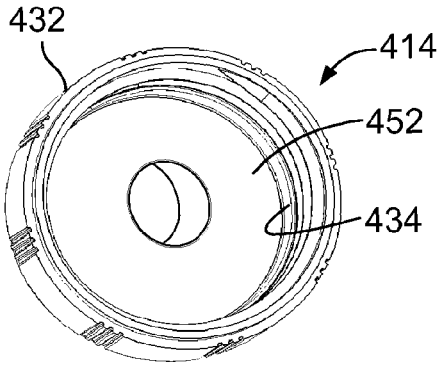
FIG. 24 is a bottom perspective view of the spout member of the dispensing closure of FIG. 23.
Figure 25:
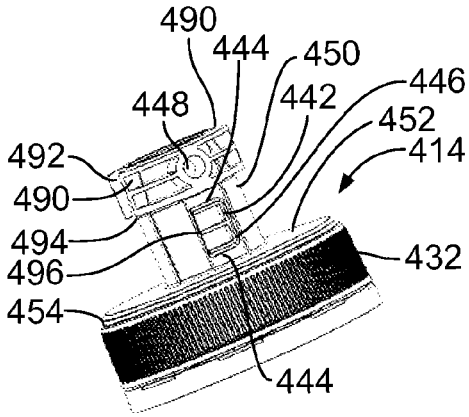
FIG. 25 is a perspective view of the spout member of FIG. 24.
Figure 26:
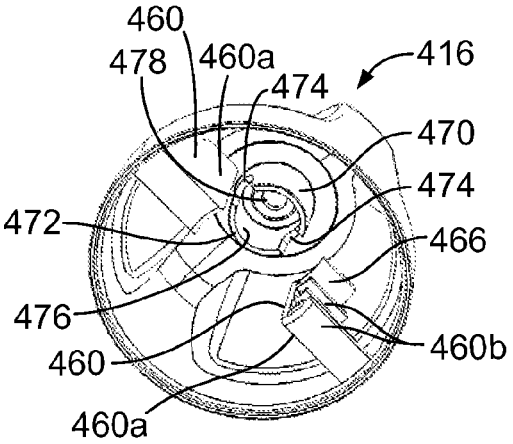
FIG. 26 is a bottom perspective view of the cap member of the dispensing closure of FIG. 22.
Figure 27:
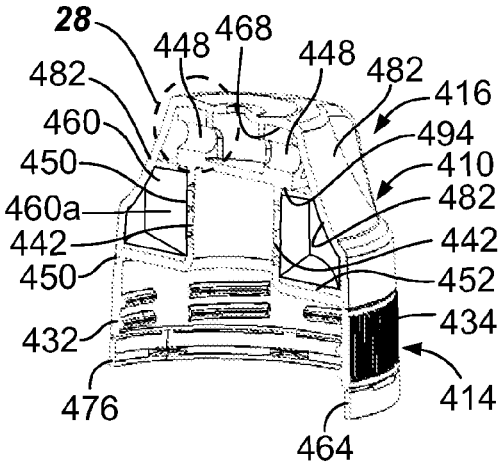
FIG. 27 is a cross sectional view of the dispensing closure of FIG. 22.
Figure 28:
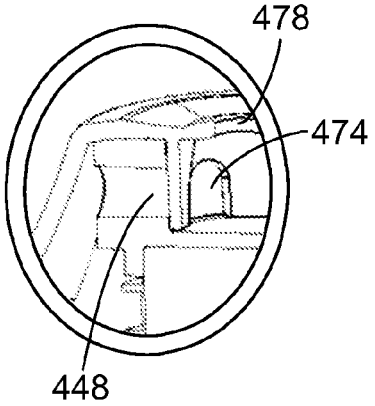
FIG. 28 is an enlarged view of Detail 28 of FIG. 27.

FIGS. 22-28 illustrate a dispensing closure 410 in accordance with another illustrated embodiment of the disclosure for a bottle or other vessel which may be useful for condiments or for other fluids or liquids. The dispensing closure 410 comprises a spout member 414 and a cap member 416 hingedly secured to the spout member by a living hinge or the like. The dispensing closure 410 may be constructed of any suitable plastic or may be constructed of any other material in accordance with other embodiments of the present disclosure.

The spout member 414 comprises a spout 450 and a circular lid 452 that prevents fluid flow from the bottle, and a cup portion 432 extending from the lid 452 that defines an interior bore 434 and seals the bottle. The spout 450 includes a pair of rupture members 442; two pairs of rupture supports 444, each pair adjacent one of the rupture members 442; and lines or areas of reduced thickness surrounding the top and bottom and rear side of each rupture member. Each rupture member 442 has a configuration roughly in the form of the number "3", defining three horizontal fingers and a back segment, but also including the portions within the fingers. The fingers of each rupture member 442 slope upward from the front end towards the back segment to form camming surfaces. The spout 450 also includes a pair of diametrically opposed backwalls 446 to prevent rotation of the cap member 416 as described below. The fingers of the rupture members 442 increase in thickness towards the backwall 446. The spout member 414 also includes a chamfered sealing surface 464 around its perimeter. A pair of rupture membranes 458 are disposed about the rupture member 442.

The locking member 440 defines a pair of diametrically opposed exit holes 448 and a pair of diametrically opposed slots 490, and includes a pair of diametrically opposed chamfers 492 associated with the slots. The cup portion 432 includes a sealing groove 454. In the illustrated embodiment, the entire spout member 414 has a monolithic construction.

The cap member 416 includes a pair of diametrically opposed cam actuators 460. Each cam actuator 460 comprising a vertical wall **460*a* and a plurality of horizontal reinforcement ledges 460***b* along the vertical walls configured to align with the fingers of the rupture members 442.

A locking surface 466 is constructed on top of the cam actuators 460. A center boss 470 is attached to the underside of the top surface. The center boss 470 comprises an outer bearing surface 472, a pair of diametrically opposed passages 474 for dispensing liquid, a bore 476 and a final exit hole 478. The spout member 414 also includes flats 482. In the illustrated embodiment, the entire spout member 414 has a monolithic construction.

During the initial assembly process, the cap member 416 is snapped into place over the spout member 414 by aligning the cam actuators 460 over the chamfers 492 of the spout 450 and applying pressure to force the cam actuators down slots 490. During assembly, the cam actuators 460 travel over the chamfers 492 and upon completion of assembly are locked in place with the spout locking surfaces 466 fully engaged under the undercut ledge 494 of the spout member 414. Bearing surface 472 engages post surface 468, creating lateral support for the spout member 414. In this position, holes 448 and passages 474 and are offset by 90 degrees and do not match up.

After assembly, the dispensing closure 410 is secured to a bottle (not shown). The bottle may have any suitable construction and may be constructed of plastic, glass or any other suitable material. Because the rupture members 442 have not been ruptured, liquid cannot pass through the dispensing closure 410, and the spout member 414 provides an airtight dispensing closure so that the pressure in the bottle can be maintained effectively at a constant level or otherwise seals the bottle.

Activation of dispensing closure 410 to allow dispensing of fluid from the bottle occurs by gripping the cap member 416 by its flats 482 and twisting the cap member 416 relative to the spout member 414. During twisting, the cam actuators 460 engage the fingers of the rupture members 442, causing the areas of reduced thickness to break and the rupture members 442 including the fingers and the portions between the fingers to deflect inwardly into or towards the bore 476. The continued rotation of the cap member 416 to a full 90 degrees forces the rupture members 442 to travel pivot inwardly into or towards the bore 476, with the front edges of the rupture members remaining hingedly secured. This action releases pressure from the bottle through the dispensing closure 410. The ruptured rupture members 442 create opening for the fluid to flow out of the bottle and from bore 476 defined by the spout member 414 into flats 482 defined by the cap member 416. As the spout member 414 is rotated to its fullest 90 degrees clockwise, holes 448 and passages 474 become aligned allowing the fluid to pass from flats 482 through the holes 448 and passages 474 and through exit hole 478. Backwalls 446 prevent further rotation of the spout member 414.

After dispensing the desired amount of fluid, the cap member 416 can then be rotated back 90 degrees. This action closes the holes 448 and passages 474. At this time, the dispensing closure 410 has upper seals and lower seals with a passage contained between these seals into the main container. The illustrated spout member 414 also includes a pair of diametrically opposed first detents 496 to prevent the cam actuators 460 from rotating back to the assembled position when the user is rotating the spout member 414 from the open position to the closed position.

The illustrated spout member 414 and cap member 416, including, for example, the rupture members 442 and cam actuators 460, may have any other structure in accordance with other embodiments of the present disclosure. For example, the spout member 414 may also include a flip top lid in accordance with an other embodiment. The dispensing closure may include any suitable tamper evidency structure.

The dispensing closure 410 may have any other suitable construction in accordance with other embodiments of the present disclosure. For example, it may have a single or multiple number of rupture members 442 and cam actuators 462 and associated structures in accordance with other embodiments of the present disclosure. Further the rupture members 442 and cam actuators 462 may have any other suitable construction in accordance with other embodiments of the present disclosure.

Advantages of the present disclosure may include one or more of the following benefits: (1) the dispensing closure in its assembled state can withstand pressure equal to a conventional flat cap; (2) the dispensing closure can be applied to carbonated beverages; (3) pressure can be applied to non-carbonated products to reduce bottle weight, and additional packaging, which results in cost savings; (4) the rupture arms can be tailored in size and geometry to provide desired flow rates; (5) the dispensing closure does not need to be removed from the bottle to activate or operate; and (6) the crossflow design of the passages directs any pressurized flow of liquid against an internal wall instead of directly at the user of the product (typical of other designs).

The foregoing description is for exemplary purposes only and is not intended to limit the scope of protection accorded this disclosure. The scope of protection is to be measured by the following claims, which should be interpreted as broadly as the contribution permits.

What is claimed:

1. A reclosable dispensing closure for a vessel containing fluid comprising a base member engageable with the vessel and a spout member engaged with the base member, the base member and spout member comprised of plastic, one of the base member and the spout member including a rupture member having a camming surface and the other of the base member and the spout member having a cam actuator for engaging the camming surface to rupture the rupture member during twisting of the spout member in a first direction relative to the base member from a sealed position to a flow position to define a flow opening in said one of the base member and the spout member and to permit fluid flow through the flow opening; wherein said one of the base member and the spout member have another rupture member having another camming surface and said other of the base member and the spout have another cam actuator for engaging the other camming surface to rupture the other rupture member during twisting of the spout member in the first direction relative to the base member from the sealed position to the flow position to define another flow opening in the spout member and to permit fluid flow through said another flow opening; wherein each cam actuator defines a channel to increase fluid flow through the flow openings when the spout member is twisted to the flow position.

2. The dispensing closure of claim 1 wherein said one of the base member and the spout member comprises the base member.

3. The dispensing closure of claim 1 wherein the rupture member is disposed adjacent the cam actuator when the spout member is in the sealed position.

4. The dispensing closure of claim 1 wherein the spout member and the base member are coaxial and the rupture member is arcuate.

5. The dispensing closure of claim 4 further comprising a stop on the other of the base member and the spout member adjacent the rupture member to limit further twisting in the first direction of the spout member relative to the base member.

6. The dispensing closure of claim 5 wherein the rupture member is hingedly attached to the stop after the spout member is rotated to the flow position.

7. The dispensing closure of claim 6 further comprising areas of reduced thickness disposed about the rupture member configured to be broken when the spout member is twisted to the flow position to rupture the rupture member and permit the rupture member to pivot relative to the stop.

8. The dispensing closure of claim 4 wherein the rupture member has an arc length relative to the coaxis of about 30 degrees.

9. The dispensing closure of claim 1 further comprising areas of reduced thickness disposed about the rupture member configured to be broken when the spout member is twisted to the flow position.

10. The dispensing closure of claim 9 wherein said one of the base member and the spout member includes a rupture member support, the areas of reduced thickness interconnecting the rupture member and the rupture member support before said one of the spout member and the base member is twisted in the first direction from the sealed position to the flow position.

11. The dispensing closure of claim 1 wherein the base and spout members each have a generally circular cross section and are generally coaxial and wherein the camming surface and cam actuator extend arcuately.

12. The dispensing closure of claim 1 wherein the spout member includes a spout defining an opening for dispensing liquid from the dispensing closure.

13. The dispensing closure of claim 12 further including a cap member hingedly connected to the spout member and moveable from a closed position to seal the spout and an open position to open the spout, the cap member rotatably coupled to the spout member.

14. The dispensing closure of claim 13 wherein the spout member includes a tamper evidency ring frangibly secured to the base member and further comprising a locking mechanism for securing the cap member in the closed position and for preventing the spout member from moving to the flow position unless the cap member and the spout member are rotated relative to the base member a sufficient distance toward the flow position to disengage the tamper evidency ring from the base member.

15. The dispensing closure of claim 14 wherein the locking mechanism comprises a flexible hook disposed on the cap member, an opening defined by the spout member for receiving the flexible hook, a slot defined by the base member for receiving the flexible hook, and a detent formed on the base member adjacent the slot for preventing the flexible hook from disengaging from the base member until the cap member and spout are rotated said sufficient distance to disengage the tamper evidency ring.

16. The dispensing closure of claim 1 wherein said one of the spout member and the base member comprises the base member, and the base member and spout member each have generally circular cross sections and are generally coaxial configured to seal the vessel, the base member including an enclosure surface extending generally perpendicular to the coaxis, the camming surface disposed on the enclosure surface and configured to be sloped away from the vessel when the dispensing closure is secured to the vessel.

17. A recloseable dispensing closure for a vessel containing fluid comprising a base member engageable with the vessel and a spout member engaged with the base member, each of the base member and spout member comprised of plastic, the base member including an enclosure surface for sealing the vessel having a pair of rupture members, each having a camming surface, the spout member having a pair of cam actuators for engaging the camming surfaces for rupturing the rupture members during twisting of the spout member in a first direction relative to the base member from a sealed position to a flow position to define flow openings in the base member and to permit fluid flow from the vessel through the flow openings; wherein each cam actuator defines a channel to increase fluid flow through the flow openings when the spout member is twisted to the flow position.

18. The dispensing closure of claim 17 wherein the spout member and the base member are coaxial and the rupture members are arcuate and have arc lengths relative to the coaxis of the spout member and the base member of about 30 degrees and the enclosure surface further comprising a pair of stops adjacent respective rupture members to limit further twisting in the first direction of the spout member relative to the base member, the rupture members hingedly attached to respective stops after the rupture members have ruptured.

19. The dispensing closure of claim 17 further comprising areas of reduced thickness disposed about the rupture members configured to be broken when the spout member is twisted to the flow position to permit the rupture members to pivot relative to the stop.

20. A recloseable dispensing closure for a vessel containing fluid comprising a first member engageable with the vessel and a second member for dispensing the fluid, each of the first and second members comprised of plastic, the first member including an enclosure surface for sealing the vessel having a pair of rupture members, each rupture member having a camming surface, the second member having a pair of cam actuators for engaging the camming surfaces for rupturing the rupture members during twisting of the second member in a first direction relative to the first member from a sealed position to a flow position to define flow openings in the first member and to permit fluid flow from the vessel through the flow openings; wherein each cam actuator defines a channel to increase fluid flow through the flow openings when the second member is twisted to the flow position.

* * * * *